US005214438A

United States Patent [19]

Brusgard et al.

[11] Patent Number: 5,214,438

[45] Date of Patent: May 25, 1993

[54] MILLIMETER WAVE AND INFRARED SENSOR IN A COMMON RECEIVING APERTURE

[75] Inventors: Thomas C. Brusgard, Riva; Thomas C. McCormick, Linthicum, both of Md.; Hendrik K. Sijgers, Reston, Va.; Corbitt T. Smith, Manhattan Beach, Calif.; William C. Winterble, Columbia; Christopher B. Schwerdt, Cattonsville, both of Md.

[73] Assignee: Westinghouse Electric Corp., Pittsburgh, Pa.

[21] Appl. No.: 745,993

[22] Filed: Aug. 9, 1991

Related U.S. Application Data

[63] Continuation of Ser. No. 521,983, May 11, 1990, abandoned.

[51] Int. Cl.[5] ..... H01Q 21/280; H01Q 19/190

[52] U.S. Cl. ..... 343/725; 343/781 CA; 343/786

[58] Field of Search ..... 343/725, 720, 781 P, 343/781 CA, 776–779, 786, 756, 909, 911 R; 342/53, 363, 365, 373, 176, 179; 333/21 A, 21 R; 250/332

[56] References Cited

U.S. PATENT DOCUMENTS

| | | | |
|---|---|---|---|
| 2,918,673 | 12/1959 | Lewis et al. | 343/786 |
| 3,165,749 | 1/1965 | Cushner | 342/53 |
| 3,380,028 | 4/1968 | Gustafson et al. | 342/53 |
| 3,568,204 | 3/1971 | Blaisdell | 343/786 |
| 3,714,652 | 1/1973 | Grabowski et al. | 333/21 R |
| 4,282,527 | 8/1981 | Winderman et al. | 342/53 |
| 4,652,885 | 3/1987 | Saffold et al. | 434/725 |
| 4,712,110 | 12/1987 | Branigan et al. | 343/786 |
| 4,734,582 | 3/1988 | Gibbons et al. | 250/332 |
| 4,866,459 | 9/1989 | Droessler et al. | 343/725 |
| 4,897,663 | 1/1990 | Kusano et al. | 343/786 |

FOREIGN PATENT DOCUMENTS

| | | | |
|---|---|---|---|
| 0000879 | 1/1987 | Japan | 342/53 |
| 0088976 | 4/1987 | Japan | 342/179 |
| 0810418 | 3/1959 | United Kingdom | 343/779 |

OTHER PUBLICATIONS

Goldstone, Lenrod, Dual Frequency MM Wave Monopulse Antenna Conf.: 1980 Int. Symp. Dig. on Antennas and Prop. Quebec Can. Jun. 1980, pp. 7–10.

*Primary Examiner*—Rolf Hille
*Assistant Examiner*—Peter Toby Brown
*Attorney, Agent, or Firm*—W. G. Sutcliff

[57] ABSTRACT

The present invention is an integrated millimeter wave (MMW) and an infrared (IR) common aperture sensor employing a common primary reflector for infrared and millimeter wave energy. An active transmitter/receiver millimeter wave horn assembly located at the focus of the primary mirror transmits and receives millimeter wave signals off the primary reflector. A selectively coated dichroic element is located in the path of the millimeter wave energy on the axis between the feed and the primary reflector. The dichroic element reflects infrared energy from the primary reflector to a focal point and at the same time transmits and focuses millimeter wave energy. An optical system relays the infrared energy to a focal plane behind the primary mirror. The dichroic element transmits and focuses millimeter wave energy without significant attenuation such that optical and millimeter wave energy may be employed on a common boresight. Improvements in the feed assembly include a four channel waveguide structure capable of azimuth and elevation determination in sum and difference configurations. A baffle and cold stop shields the optical system from unwanted infrared radiation. Electrical transmit and receive circuitry and a correction circuit provide high probability of detection and low false alarm rate.

29 Claims, 11 Drawing Sheets

MILLIMETER WAVE AND INFRARED SENSOR IN A COMMON RECEIVING APERTURE

This application is a continuation of application Ser. No. 07/521,983 filed May 11, 1990 and now abandoned.

BACKGROUND OF THE INVENTION

1. Field of the Invention

This invention relates to antenna sensors and in particular to a millimeter wave and infrared sensor employing a common receiving aperture.

2. Description of the Prior Art

False target acquisitions have degraded the cost effectiveness of single sensor seekers. Weather conditions and the time of day may adversely affect the ability of the sensor to acquire the target. Millimeter wave (MMW) energy is useful under adverse weather conditions. However, the resolution is not as precise as exhibited by optical systems operating in the infrared (IR) region. In an optical system, resolution is adversely affected by rain, fog or humidity. These conditions can reduce the effectiveness of such sensors in the optical spectral region. Target acquisition can be substantially improved by combining millimeter wave and infrared optical signals, substantially reducing the influence of climatic conditions. IR and MMW are also susceptible to known countermeasures of various kinds and therefore a combined aperture system is less susceptible to a single type of countermeasure.

SUMMARY OF THE INVENTION

The present invention is an integrated millimeter wave (MMW) and an infrared (IR) common aperture sensor employing a common primary reflector for infrared and millimeter wave energy. An active transmit/-receive RF feed horn assembly located at the focus of the primary mirror transmits and receives millimeter wave signals off the primary reflector. A dichroic element has a selectively coated surface which transmits the millimeter wave energy and reflects the infrared energy toward IR optical elements, which in turn relay and focus the IR energy on a detector. The other surface of the dichroic element is shaped for optimum millimeter wave performance. In the millimeter wave region the two surfaces of the dichroic element form a millimeter wave lens, which focuses the millimeter wave energy at the feed horn. Improvements in the feed horn assembly include a four channel waveguide comparator structure capable of azimuth and elevation discrimination of the sum and difference energy components. A baffle and cold stop shields the optical system from unwanted infrared radiation. The baffle is shaped to allow the millimeter wave energy to be reflected from the mirror with minimum central obstruction in both wavelength regions. Electrical transmit and receive circuitry, infrared circuitry and a correlation circuit provide high probability of detection and low false alarm rate.

DESCRIPTION OF THE PREFERRED EMBODIMENT

Figure 1:
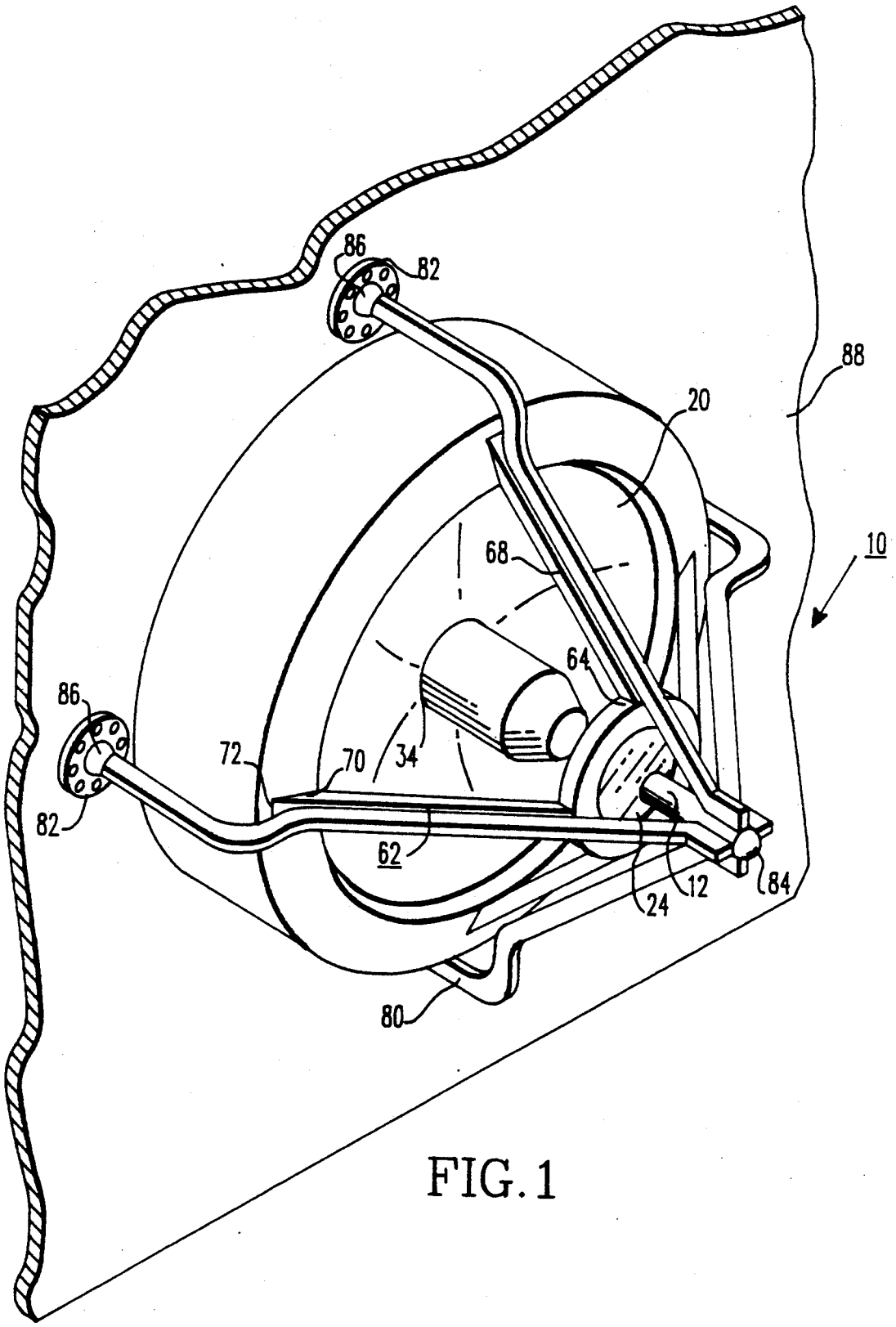
FIG. 1 is a perspective view of a dual mode aperture according to one embodiment of the invention mounted on a test stand.
Figure 2:
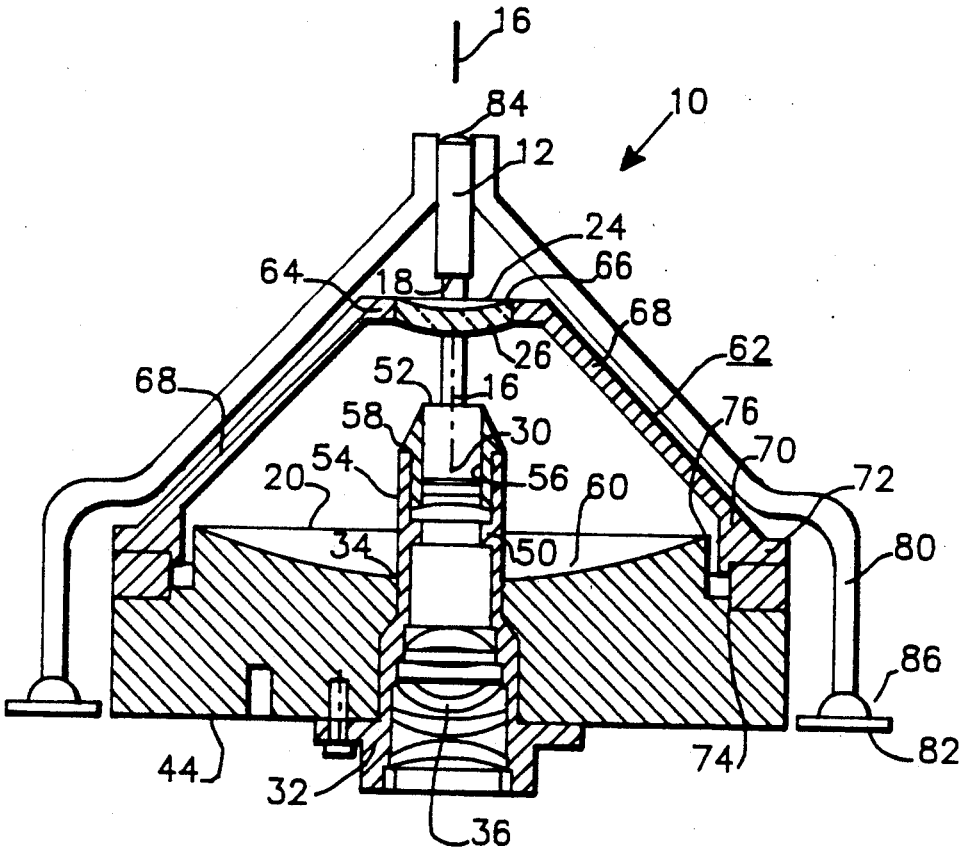
FIG. 2 is a side sectional view of a dual mode aperture according to the invention.

Referring to FIGS. 1-5 a dual mode infrared (IR) and millimeter wave (MMW) common aperture assembly 10 is shown. The invention employs a millimeter wave (94 GHz) transmitter/receiver or feed horn 12 and an infrared sensor 14 aligned on a common boresight or central axis 16. The feed horn input/output 12 is located at the focus 18 formed by the primary parabolic mirror 20 and a dichroic element 24 located between the feed horn 12 and the primary mirror 20 on the axis 16. Millimeter wave energy 22 transmitted by the feed horn 12 is focused by the dichroic element and reflected off the primary mirror 20 and directed at a remote target not shown. Energy reflected from the target likewise strikes the primary mirror 20 and is directed to the feed horn 12 through the dichroic element 24 as illustrated by the dotted ray traces 22. The dichroic element 24 has an infrared reflective surface 26 (FIG. 2) facing the primary mirror 20. Infrared radiation 28 from the target (not shown) strikes the primary mirror 20 and is reflected to the dichroic element 24 which focuses the infrared energy 28 at a secondary focus 29 on the axis 16. The primary mirror 20 and dichroic element 24 are in a cassegrain configuration.

An optical system 32 is located in an aperture 34 of the primary mirror 20 and lies along the axis 16 as shown. The optical system 32 relays the infrared energy to a series of lenses 36 to the detector 14 located in the focal plane of the optical system. 34. The detector 14 is a focal plane array which may be located within a cryogenically cooled housing 42.

A cold stop 41 in the form of a wall 41 having an aperture 43 therein is located in the housing 42 behind the window 40. The cold stop shields the detector 14 from unwanted infrared energy, i.e., energy not within the aperture defined by the primary reflector 20. The aperture 43 in wall 41 is sized so as to be matched, i.e., optically equivalent to the size of the primary reflector 20 as relayed by the lenses 36.

Figure 3:
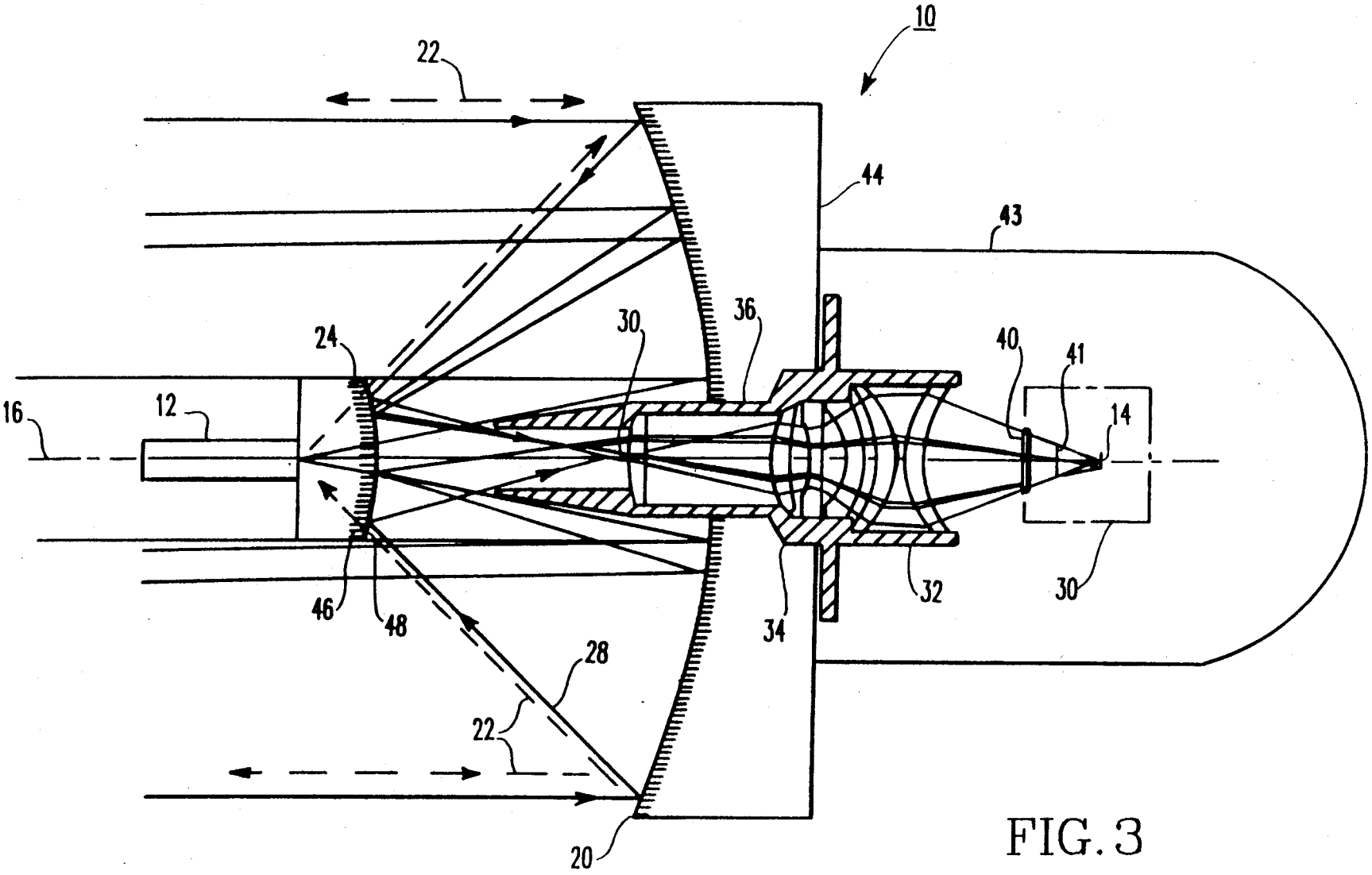
FIG. 3 is a schematic diagram of the dual mode aperture of the invention with a ray trace.
Figure 3A:
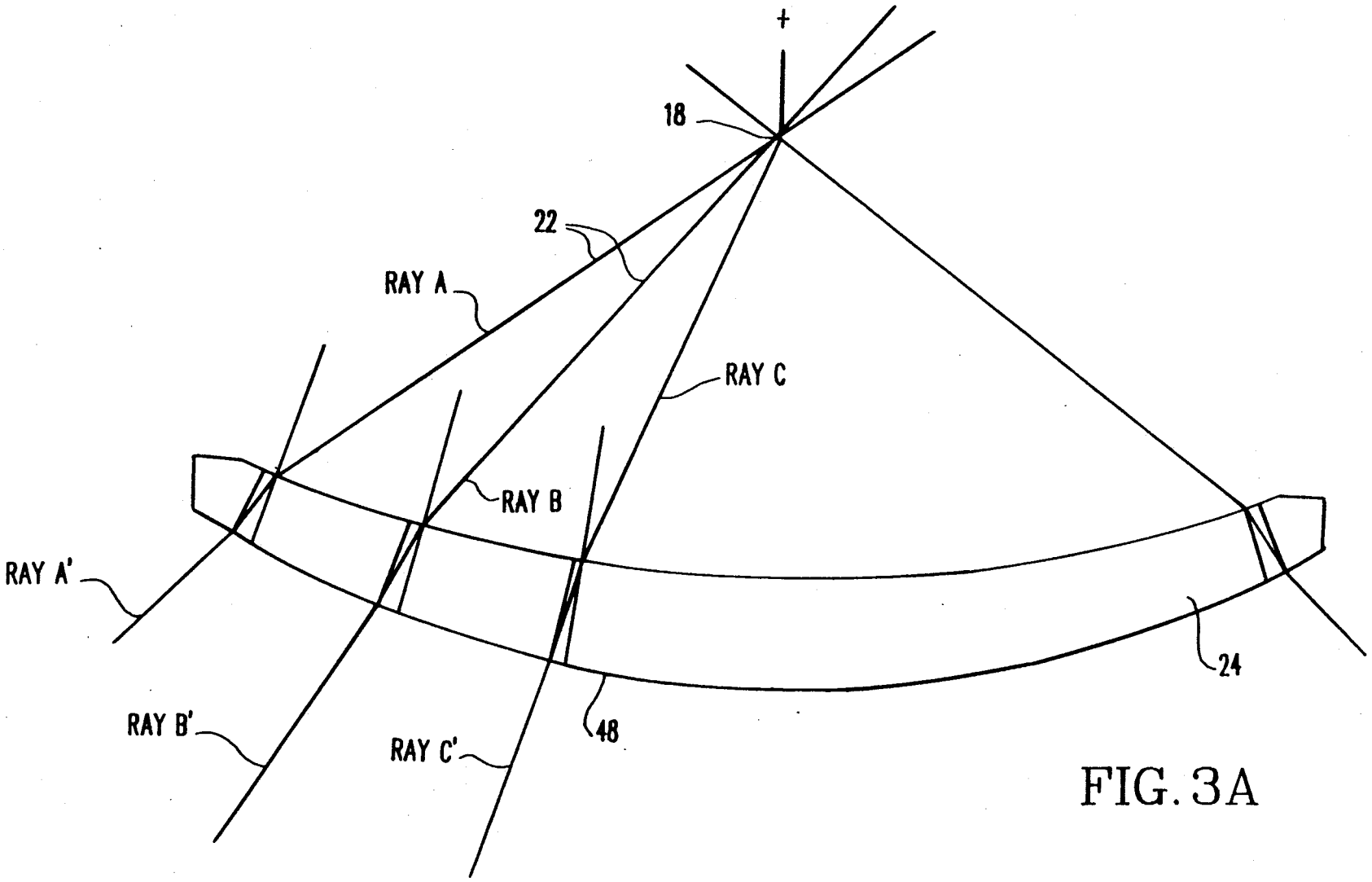
FIG. 3A is an enlargement of the dichroic element illustrating millimeter wave focusing by means of ray traces.

The dichroic element 24 is formed of a millimeter wave transparent substrate 46 having a dielectric dichroic coating 48 formed thereon. The coating 48 is selectively reflective of infrared radiation and being dielectric, i.e., non-conductive, is transparent to the millimeter wave energy. In addition, the surfaces of the dichroic element 24 may be shaped to focus the millimeter wave energy onto the feed horn aperture. In particular, FIG. 3A shows millimeter wave energy rays: A—A', B—B' and C—C' which are focused by the dichroic element 24. In a preferred embodiment, the dichroic element 24 acts as an IR optical element and a millimeter wave optical element. Thus dichroic element 24 may be located as shown in the path of the millimeter wave energy 28 on the axis 16 of the system. This allows the millimeter wave transmitter receiver 12 and the infrared detector 14 to be co-boresighted on the same axis without interfering with one another. The advantage of the co-boresighting arrangement is that IR and MMW images may be correlated for fewer false alarms and higher detection probability. Another advantage is that the structure is compact. The surfaces, of the dichroic element can also shaped to correct for errors introduced by radome structures.

The optical system 32 comprises a housing 50 which has an input end 52 located on the axis 16 between the dichroic element 24 and the secondary focus 30 as shown. A forward portion or baffle 54 of the housing 50 which extends from the input end 52 towards the primary mirror forms a recess 56 surrounding the secondary focus 30. The baffle 54 shields the lenses 36 in the optical system 32 from stray infrared radiation except that infrared radiation 28 which is reflected from the primary reflector 22 and the dichroic element 24 to the focus 30 as shown. The baffle 54 combined with the cold stop 41 improves optical performance.

The baffle 54 has a tapered conical end portion 58 which provides clearance for millimeter wave energy 22 emanating from the feed horn 12 or reflected to the feed horn by the primary mirror. It has been found that millimeter wave energy tends to be more concentrated in the region 60 near the center of the primary reflector 20. Accordingly, the conical taper 58 minimizes scattering of the more concentrated millimeter wave energy 22 and reduces the millimeter wave shadow region on the primary reflector 20 and thus improves the overall system gain and side lobe level.

A support member 62 carries the dichroic element 24. The support member has an apertured upper support ring 64 for supporting the dichroic element 24 in the central aperture 66 therein. Radial arms 68 extend from the support ring 64 towards the support structure 44 as shown. Free ends 70 of the radial arm 68 are secured to a lower support ring 72 which is located in a recess 74 in the support structure 44 adjacent the marginal edge 76 of the primary mirror 20 as illustrated. The support structure 62, in a preferred embodiment, is machined from a single of piece of material for extra strength.

The feed horn 12 is fed by a plurality of waveguides 80. In the embodiment shown, four waveguides are employed which provide sum (Σ, Sigma) and difference (Δ, Delta) channels for each elevation and azimuth measurements as hereinafter described. The waveguides 80 are channel like members which extend from a terminal end 82 near the support structure 44 upwardly and adjacent a corresponding radial arm 68 of the support member 62 beyond the upper support ring 64 to U-bend 84 for attachment to the feed horn 12 as illustrated. Millimeter wave energy transmitted and received by the feed horn 12 is conducted through the U-bend and the various waveguides 80 to RF equipment (not shown) for processing. Likewise, infrared energy received by the infrared sensor 14 is electrically coupled to external equipment (not shown) by appropriate connections into the housing 30 and dewar 43. In the drawings the terminal end 82 of the waveguide 80 has a flange 86 which is used for mounting or securing the waveguide 80 to suitable supporting structure, see for example FIG. 1, in which the sensor 10 is mounted on a movable test fixture 88.

Figure 4:
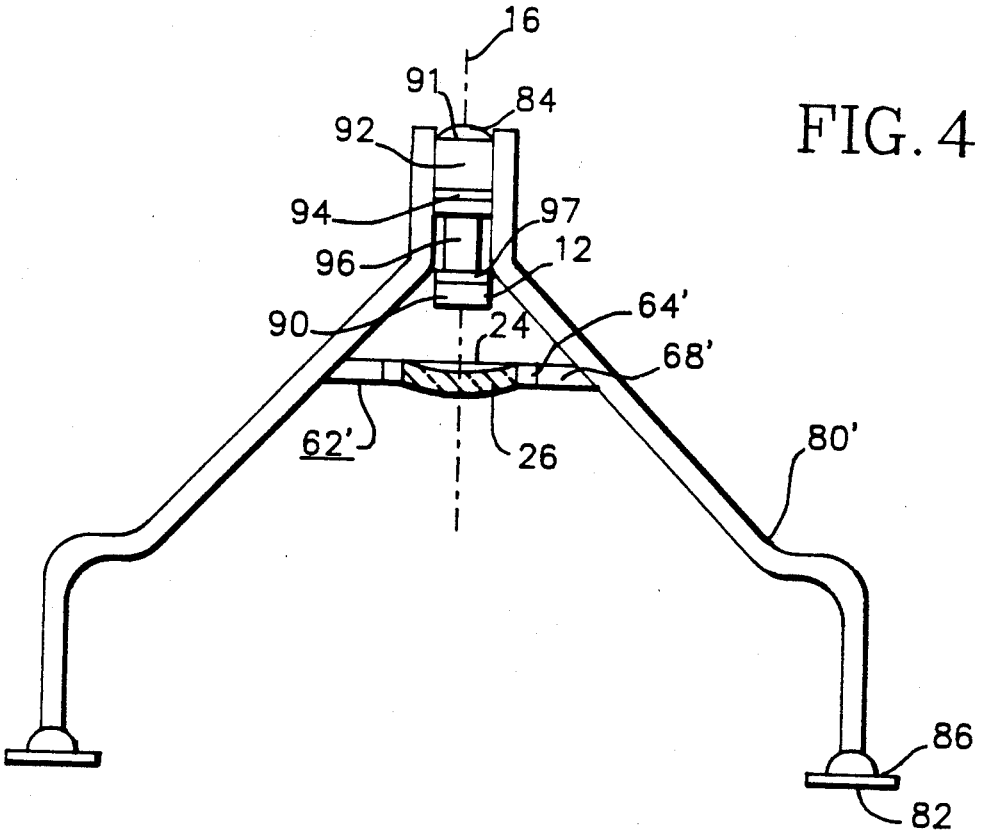
FIGS. 4 and 5 are respective side and bottom views of a waveguide subassembly employed in the dual mode aperture illustrated in FIG. 1 with portions removed.
Figure 5:
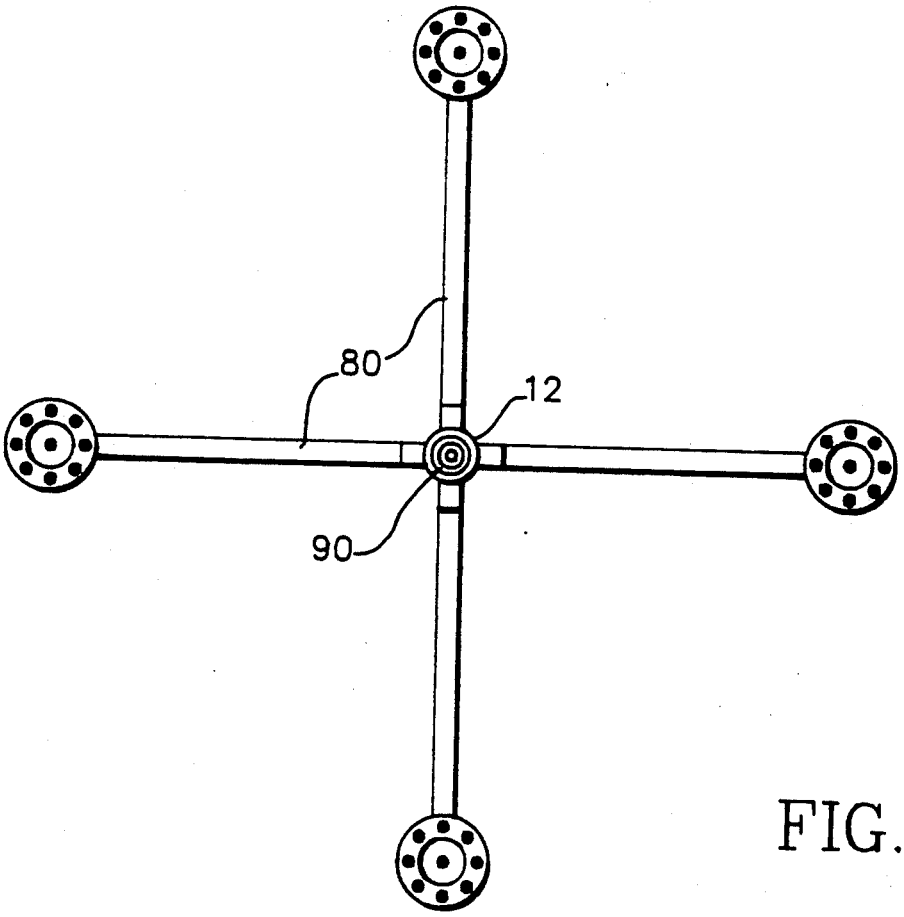

In another embodiment modified waveguides 80', feed horn 12 and a supporting structure 62' for the dichroic element 24 are combined in the arrangement illustrated in modified FIGS. 4 and 5 as a subassembly. In FIG. 4 the waveguides 80' are shown in side elevation with two of the waveguides (the front and the rear) removed for clarity. The dichroic element 24 may be supported in modified upper support ring 64' which is attached to the waveguides 70' by radial arms 68'.

The feed horn 12 is supported by waveguides 80' centrally on the axis 16 and the feed horn 12 has an aperture 90 directed towards the primary reflector 20 on the axis 16. In the arrangement, the feed horn 12, includes a distributor 91, a comparator section 92 and a transformer section 94, a polarizer section 96, combining aperture 97 and the radiating aperture 90, all of which are serially connected to the U-bend 84. The U-bend portion 84 is arranged such that each of the waveguides 80 coupled thereto has a waveguide path inverted 180° for distribution to individual channels via distributor 91 to the comparator 92 which provides a 90° phase change of the signal carried by the diametrically opposed waveguides. The transformer 94 coupled to the comparator 92 provides another 90° shift in the signal such that the total phase shift is 180°. Accordingly, signals thus coupled to the feed horn 12 represent the sum and the difference values of transmitted and reflected millimeter wave energy.

In FIG. 5 the supporting structure 62' has been removed for clarity. The arrangement illustrates horizontally diametrically opposed waveguides 80' which represent the sum and difference channels for the azimuth and the vertically diametrically opposed waveguides 80' represent the sum and difference channels for the elevation energy.

Polarizer 96 couples the millimeter wave energy for each channel to the radiating aperture through a circular polarizer. Combining aperture 97 channels and combines the outputs between polarizer 96 and radiating aperture 90. The radiating aperture 90 transmits and receives the energy from each of the waveguides 80' along the central axis 16.

Figure 6:
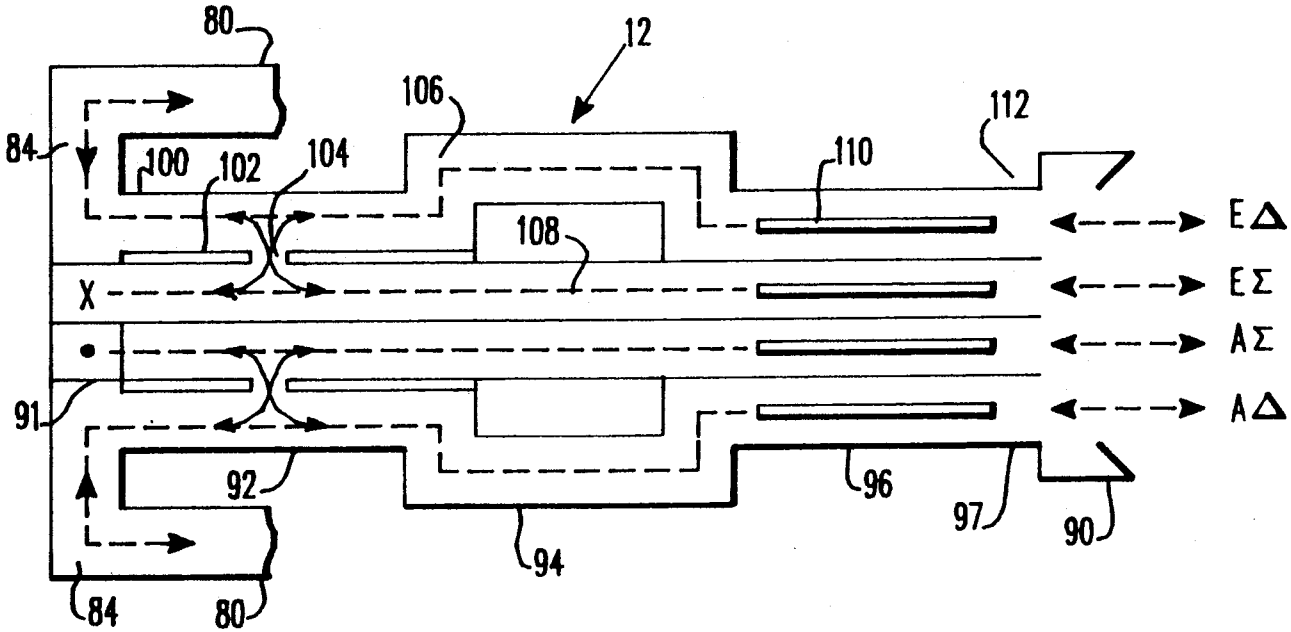
FIG. 6 schematically illustrates various feed horn stages.
Figure 7:
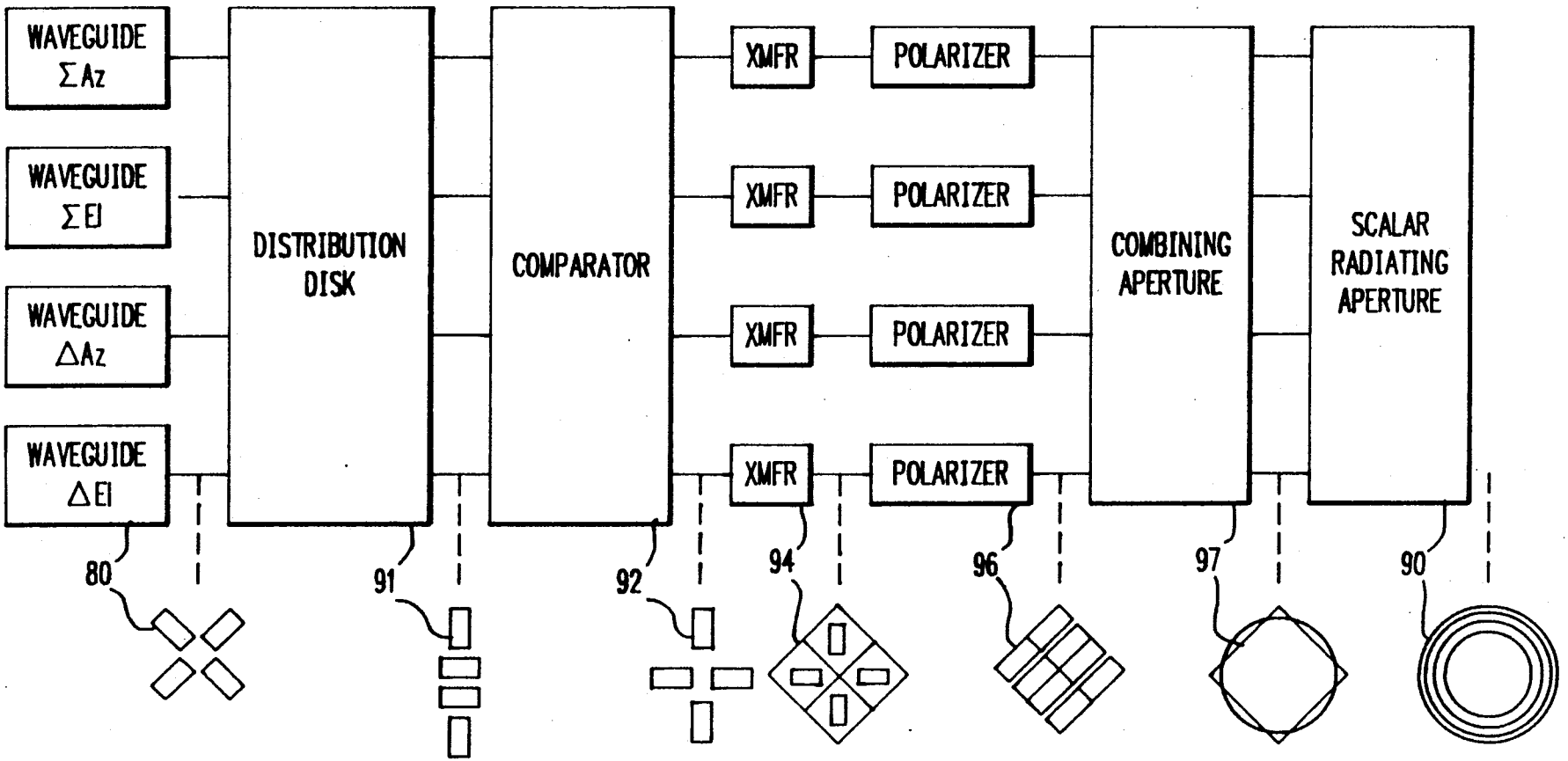
FIG. 7 illustrates the layout and functional relationship of the various feed horn stages illustrated in FIG. 6.

FIGS. 6–7 illustrate schematically the various feed horn stages which may be in the form of coaxial stacked disks 90, 91, 92, 94, 96 and 97 having channels or apertures formed with appropriate cross sections to route, orient and modify the signals. The disks 90, 91, 92, 94, 96 and 97 of FIG. 7 are arranged in FIG. 6 as a plurality of coaxially stacked sections, functionally referred to hereinafter as: aperture 90, distributor 91, comparator 92, transformer section 94, polarizer section 96 and aperture 95, respectively. In the arrangement, the waveguides 80 feed each of the respective channels EΣ, EΔ, AΣ and AΔ. The letter E represents elevation, the letter A represents azimuth, Δ represents a difference signal and Σ represents a sum signal. In the elevation channels, EΔ and EΣ, the waveguides 80 conduct energy via the U-bends 84 and distributor 91 to the input side 100 of the comparator 92. Similarly, EΣ energy is coupled to the comparator 92 via a U-bend 84 (into the page) to the input side 100 of the comparator 92. A common wall 102 separates the EΣ and EΔ channels as shown. An iris 104 formed in the wall 102 between the EΔ and EΣ allows for signal crossover. Energy propagates through the iris 104 thereby creating a 90° phase shift between the channels. In the EΔ channel the energy propagates to the transformer section 94 whereupon it experiences another 90° phase shift as a result of one or more jogs 106 in the channel which increases the path length and hence phase shift of the signal. The path length of the EΣ signal represented by the straight run is thus 180° out of phase with respect to the EΔ signal. Accordingly, the signals may be processed to represent the sum Σ and difference Δ of energy radiated to and from the target.

The energy is thereafter coupled to the polarizer section 96 in which a phase card 110 in the form of dielectric substrate is located diagonally with respect to each of the EΣ and EΔ channels such that the energy becomes circularly polarized. Thereafter the energy is combined in aperture 97 at the output 112 of the polarizer and coupled to the radiating aperture 90 as illustrated. The AΔ and AΣ channels are similarly configured. Also in order to achieve spatial alignment in the elevation and azimuth, the channels are shifted spatially as illustrated in FIG. 7.

Figure 8A:
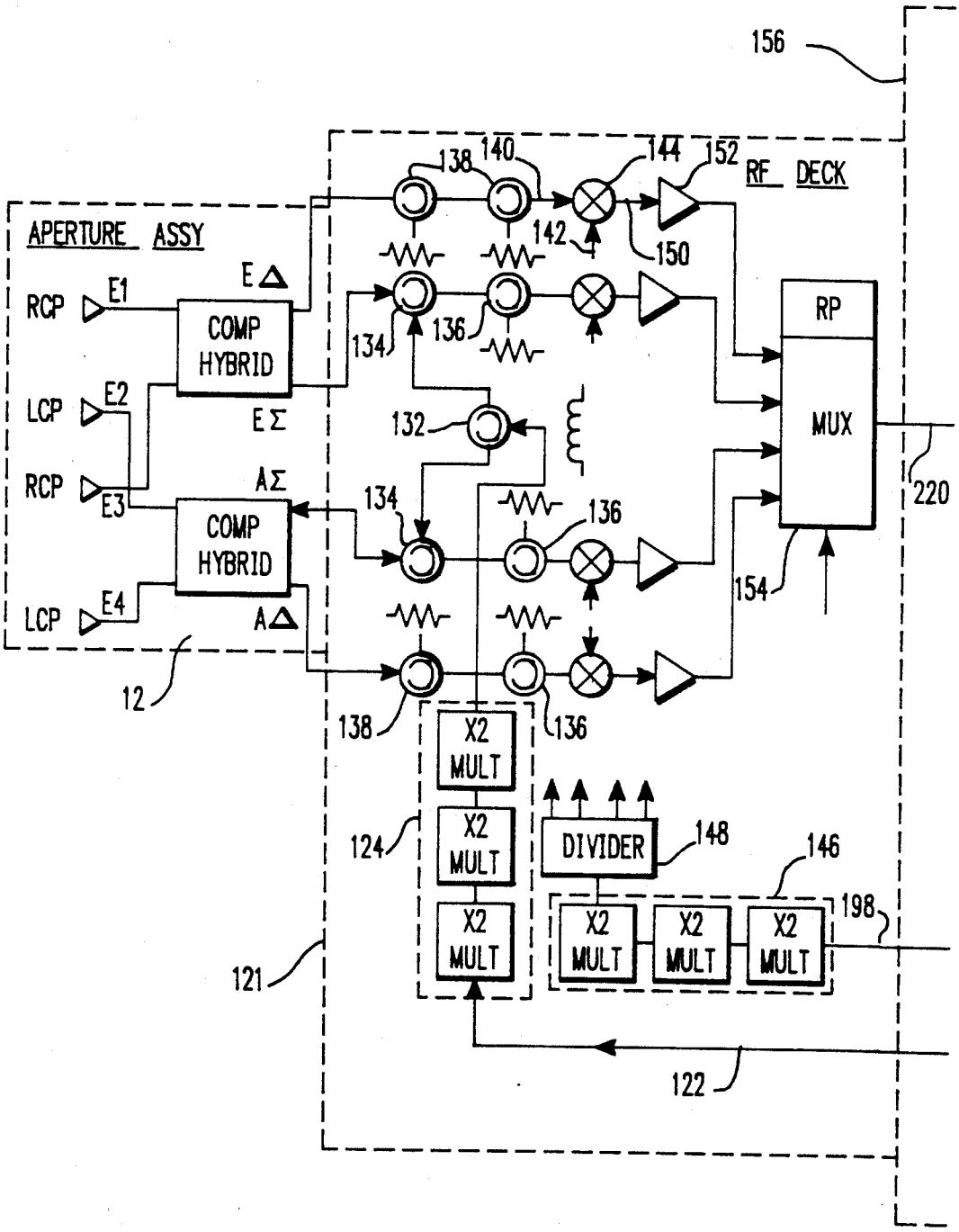
FIGS. 8A and 8B show a schematic diagram of a transmitter/receiver circuit employed in the present invention.
Figure 8B:
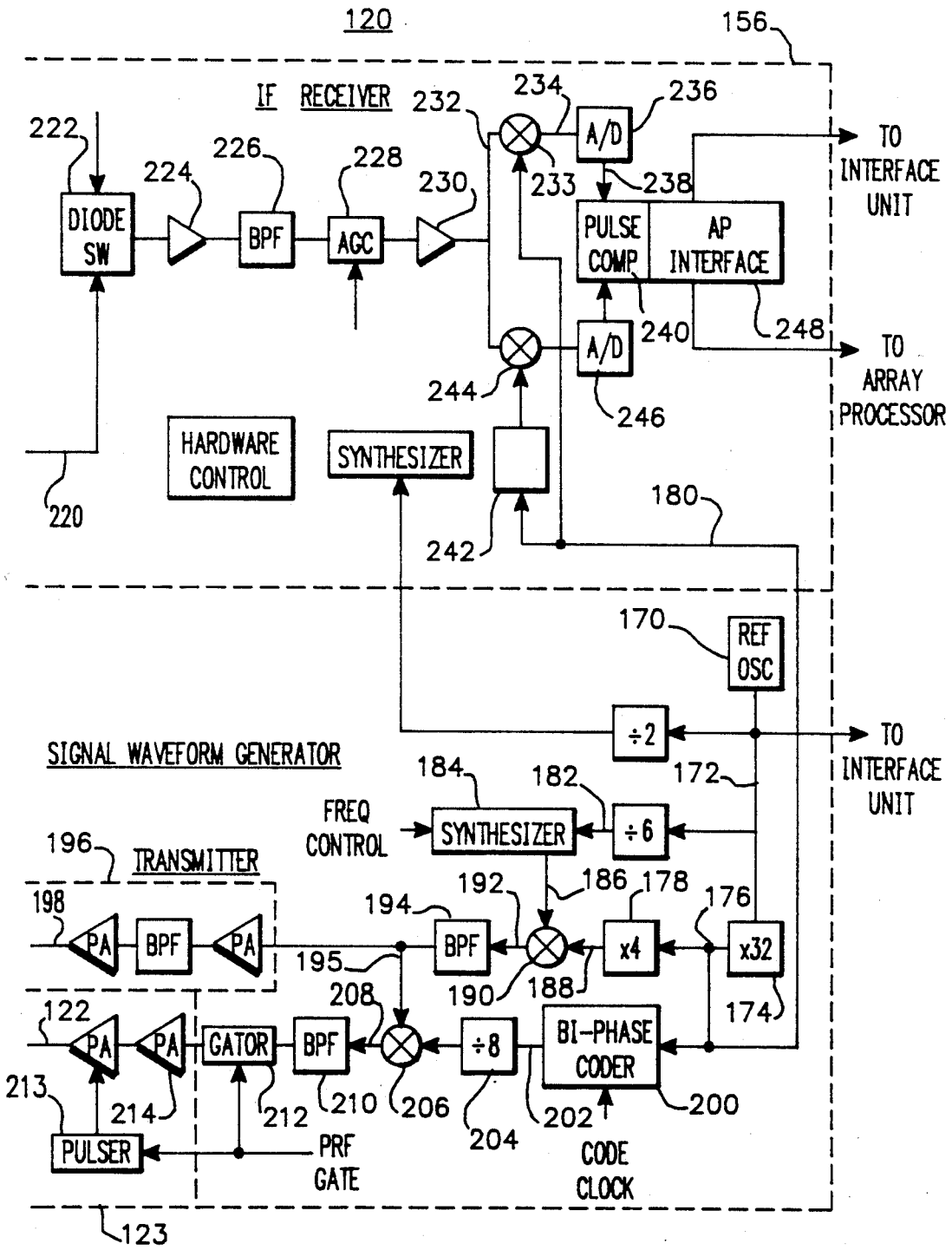

FIG. 8 illustrates the electrical circuitry for a transmit and receive module 120 which may be incorporated into the sensor of the present invention. In the arrangement, the feed horn 12 is illustrated as a four port device having AΣ, AΔ, EΣ and EΔ channels as illustrated. The feed horn 12 is coupled by means of the waveguide to the respective Σ and Δ channels of the elevation and azimuth routing circuitry 121. A transmit pulse 122 from transmitter circuit 123 is coupled to a three stage times two multiplier 124. A manageable high frequency transmit signal 122 of about 11.75 GHz may be then be multiplied by 8 to result in a 94 GHz output signal 130 which is coupled via transmit circulator 132 to one or the other azimuth and elevation AΣ, EΣ channels to the feed horn 12. Isolating circulators 134 alternately couple the energy to the output. Additional isolating circulators 136 protect the receiver circuitry during transmit as well. Circulators 138 on the Δ channels provide balanced isolation as well. The various circulators 132, 134, 136 and 138 are controlled by an appropriate control circuit (not shown) in accordance with known techniques. On the receiver side signals 140 are routed alternately to one of the various channels by the isolating circulators 134, 136 and 138. A local oscillator signal 142 is combined with the return signal 140 in the mixer 144 via the times 8 multiplier 146 and the power divider 148. The combined local oscillator signal 142 and the return signal 140 produce intermediate signal 150 which is amplified in the amplifier 152 and coupled to the switching network 154 which multiplexes the various signals for coupling to receiver circuit 156.

In the transmitter circuit 123, reference oscillator 170 produces a reference frequency 172 for the system. The reference oscillator output 172 is coupled to multiplier 174 which multiplies the signal 172 by 32 and supplies an output 176 to a×4 multiplier 178. The output of the multiplier 174 is also coupled to the receiver unit 156 by output line 180 to provide a local oscillator signal (LO2) to the receiver circuitry as hereinafter described. The output 172 of the reference oscillator 170 is also coupled to the divide by 8 circuit 182 and synthesizer 184 which combines its output 186 with the output 188 of the multiplier 178 in the mixer 190. The mixer output 192 is filtered in band pass filter 194 and further amplified and filtered in succeeding amplifier and filter stages 196, the output of which 198 is coupled to the multiplier 146 which supplies the local oscillator (LO1) signal 142 to the mixers 144 via the power divider 148 in the routing circuit 121.

The synthesizer 184 and divide by 8 circuit 182 provide a phase reference for the local oscillator signal. When mixed with the output of the multiplier 178, the synthesizer 184 imposes a stepwise increase in the output 192 to step up the frequency in incremental steps. In the arrangement illustrated, a 32 step sequence in 600 KHz increments is provided.

The output 176 of the multiplier 174 is also coupled to a bi-phase coder 200 which phase shifts the signal in a coded fashion (e.g., Barker code). The output 202 of the coder 200 is coupled to divide by 8 circuit 204 which is coupled to the mixer 206 which receives the output 195 of the band pass filter 194 to step up the frequency producing a 11.75 GHz output at 208. The signal at 208 is filtered by band pass filter 210 and gated through gate circuit 212 and subsequently amplified in two stage amplifier 214 to produce the transmit pulse 122 which is multiplied in the multiplier 24 to boost the signal to 94 GHz at the input 130 to the circulator 132 and the feed horn 112 as described above. Pulse 213 gates amplifier 214 with a long pulse R bracketing the gate 212 to thereby assure that amplifiers 214 are on.

On the receiver side 156; the output of the multiplexer 154 receives the input signal 140 which has been mixed with the local oscillator 142 to produce a low frequency input at 2.56 GHz 220 for processing. After gating in the diode switch 222, the input 220 is amplified at 224, band pass filtered at 226 and stabilized by automatic gain control 228. At 230, the signal is amplified and split into the I and Q circuits. In the I circuit, the LO2 signal 180 generated by the reference oscillator 170 and multiplied by circuit 174 is mixed at 233 with the output 232 of the amplifier 230 to produce a base band video output 234 for the A/D converter 236. The digitized signal 238 at the output of the A/D converter 236 is coupled to the pulse compressor 240 which is a filter matched with the code imposed by the bi-phase coder 200 referred to above. Thus, the transmitted pulse 130 which carries the code imposed thereon by the bi-phase coder 200 is effectively decoded with an improve signal to noise ratio at the pulse compression stage. In the Q circuit, the LO2 signal 180 is 90° phase shifted at 242 and coupled to mixer 244, A/D converted at 246 and decoded in the pulse compressor 240. The I and Q circuits are thereafter coupled to the interface 248 for down stream processing.

Figure 9:
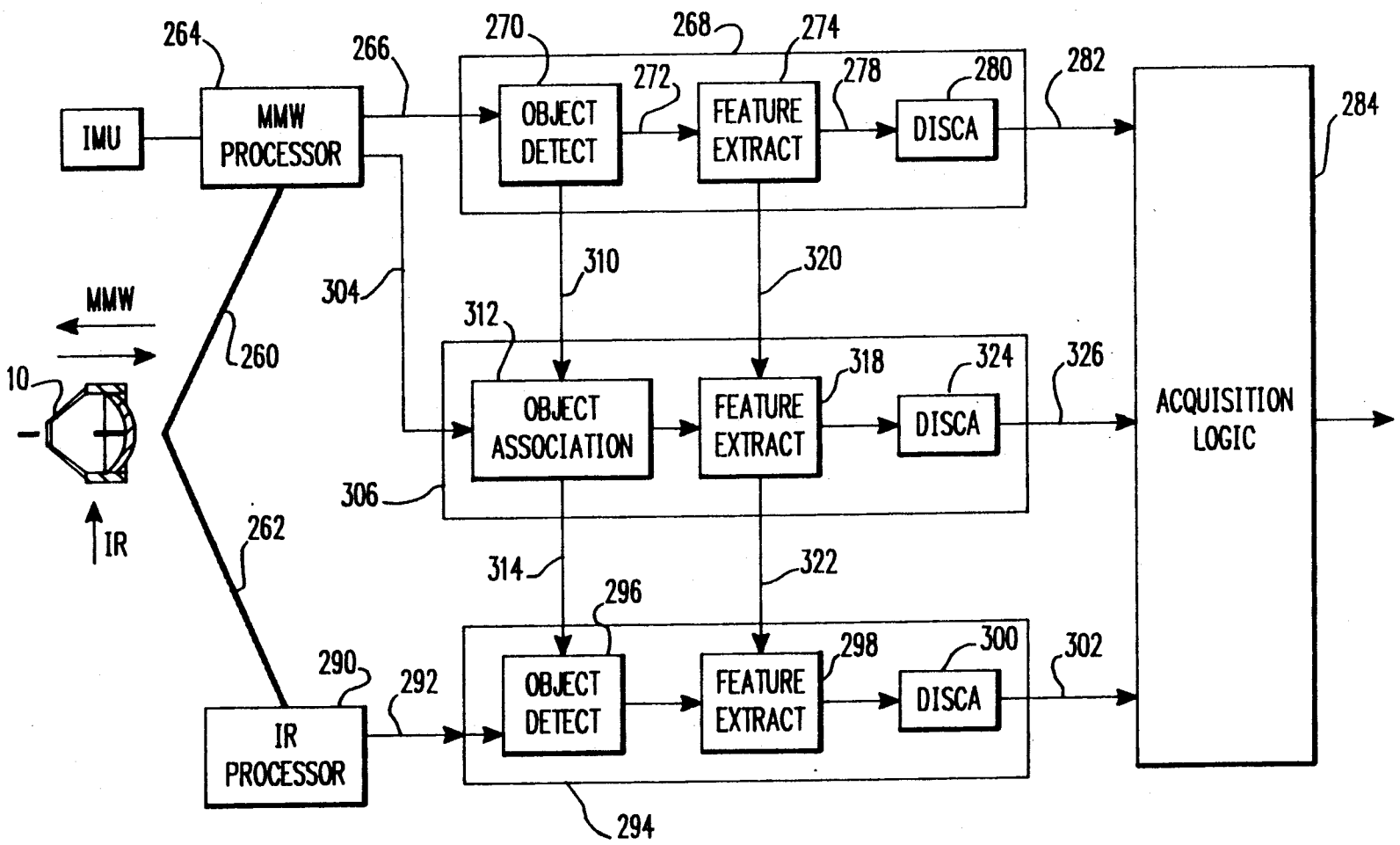
FIG. 9 is a schematic block diagram of an electronic processor employing image correlation processing circuitry for millimeter wave and infrared signals.

In FIG. 9, an overall block diagram of the system is illustrated in which the dual mode sensor has outputs 260 and 262 corresponding to millimeter wave and infrared signals, respectively. The millimeter wave signal 260 is coupled to the millimeter wave processor 264 described above with respect to FIG. 8. One output 266 of MMW processor 264 is coupled to millimeter wave imaging stage 268 in which the output 266 of the processor 264 is image processed. In the millimeter wave imaging stage 268; object detection circuit 270 detects the object (not shown) and produces a detection image output 272 to the feature extract circuit 274 which produces millimeter wave features 278 which are coupled to a discriminator 280 (e.g., threshold detector). The output 282 of the discriminator 280 produces a target detection feature vector which is coupled to the acquisition logic 284 which verifies the target.

The infrared output 262 is similarly processed in IR processor 290, the output of which 292 is coupled to the IR imaging stage 294 in which object imaging occurs at 296, feature extraction occurs at 298 and discrimination occurs at 300, the output 302 of which is coupled to the acquisition logic 284 which provides a target detection feature vector in the infrared spectrum. An image position signal 304 produced by the MMW processor 264 locates the image angle. The signal 304 is coupled to the correlation imaging circuit 306 which receives corresponding outputs from the MMW image processor 268 and the IR image processor 294 as shown. For example, an output 310 from the object detection circuit 270 in the MMW image processing circuit 268 is coupled to the object association circuit 312 in correlation circuit 306. Likewise an output 314 from the infrared object detection circuit 296 is coupled to the object association circuit 312. The output 316 of object association circuit 312 is coupled to the feature extraction circuit 318 in the correlation circuit. Outputs 320 and 322 from the respective feature extraction circuits 274 and 298 are also input to the feature extraction circuit 318 to superimpose the images and features. Discrimination circuitry 324 is coupled to the acquisition logic. In the arrangement illustrated in FIG. 9, in addition to providing individual microwave and infrared image processing, outputs of such image processing circuits are correlated in the correlation circuit 306 which ignores features which do not occur in both the infrared and millimeter wave spectral regions. Accordingly, accuracy of the system is improved because features which occur in both regimes are most likely to be of interest. Thus, signals which may be indicative of an alarm but which do not occur in both regimes can be ignored as false thereby reducing the false alarm rate, and at the same time increasing the probability of detection when the signals in both frequency regimes are correlated.

A further advantage of the present invention is that, because the sensor 110 operates in two modes with a common boresight, pointing accuracy is improved. Accordingly, the infrared image and the millimeter wave image may be accurately superimposed one on top of the other in the correlation processor 306 to thereby enhance the overall resulting image. The arrangement of the present invention is also highly resistant to countermeasures because it is difficult to counteract a system in two such widely diverse spectral regions.

Figure 10:
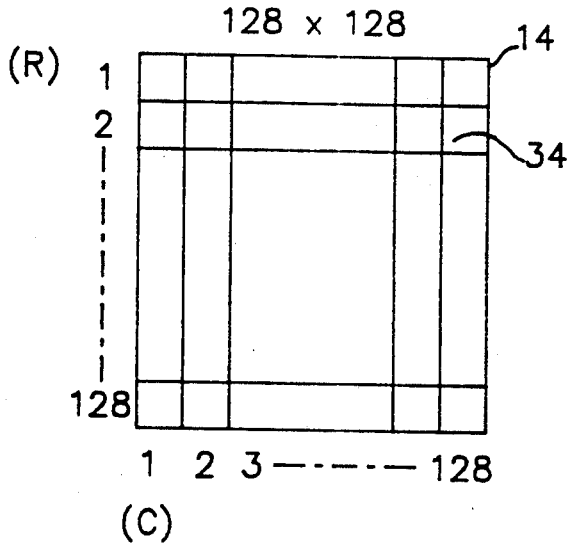
FIG. 10 is a schematic illustration of a focal plane array employed as an optical image detector in the dual mode aperture of the invention.

The present invention also provides a dual mode imaging and searching feature illustrated in FIG. 10 wherein the infrared focal plane array 14 referred to hereinbefore has a 128×128 array of pixels 340 configured in columns C and rows R. In a scanning mode, the columns C may be scanned sequentially in a line scanning mode from left to right to find a target. Thus, any pixel 340 which is illuminated by infrared radiation is responsive to produce an output which may processed in the infrared processor 290 on a very fast basis. As the image is processed the scanning may be altered so that the entire array of rows R and columns C may be further analyzed and processed. Accordingly, during the seeking mode infrared detection is accelerated and during the processing mode high resolution image processing is performed.

Figure 11:
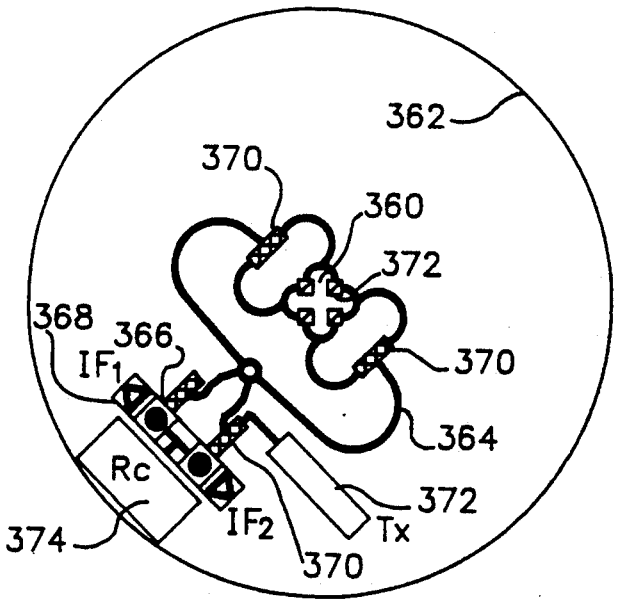
FIG. 11 is a schematic diagram of a patch antenna which may be alternatively employed as a transmitter and receiver for high frequency energy.

In an alternative embodiment as illustrated in FIG. 11, a solid state patch antenna 360 may be located on a silicon substrate 362 and coupled by striplines 364 and mixers 366 to amplifiers 368. Switches 370 appropriately route the signals to the various patch antenna elements 372. If desired, transmitter 372 and receiver 374 circuitry for the T/R module 120 illustrated in FIG. 8 may be integrated on the substrate 362. In the arrangement illustrated, the patch antenna 360 may be mounted above the dichroic element 24 with coaxial cables in lieu of the feed horn 12 and waveguides 80 illustrated in FIGS. 1-4, thereby greatly reducing size, cost and complexity of the system.

A radome R (FIG. 9) may be provided to protect the aperture from the environment. The radome may be made from materials which transmit both millimeter wave, and infrared energy. Focus errors caused by the radome may be reduced in the millimeter wave system by optimization of the shape of the surfaces of the dichroic element 24. Focus errors caused by the radome may be eliminated by optimization of the lens curvatures in the optical system.

While it has been described what at present is considered to be the preferred embodiment of the present invention, it will be apparent to those skilled in the art that various changes and modifications may be made therein without departing from the invention. Accordingly, it is intended in the appended claims to cover all such change and modifications as come within the true spirit and scope of the invention.

What is claimed is:

1. An infrared (IR) and millimeter wave (MMW) common aperture antenna for transmitting MMW energy to space and for receiving MMW and IR energy from space through said common aperture comprising:

an apertured primary parabolic reflector having a reflective front surface sized for defining said common aperture, said primary reflector for reflecting infrared and millimeter wave energy impinging thereon, said primary reflector having a central opening, a central axis passing therethrough, and a focus spaced from the reflective surface on the axis;

a millimeter wave feed assembly having a feed horn located on the axis in the vicinity of the focus of the primary reflector for feeding millimeter wave energy for transmission along a path from the feed horn to the front surface of the primary reflector for reflection therefrom to space and for receiving millimeter wave energy from space reflected from the primary reflector along the path to the feed horn; and a dichroic element having front and rear surfaces non-uniformly spaced apart and being shaped for defining a millimeter wave lens, said dichroic element being located in the path between the feed horn and the primary reflector having an axis coaxial with the primary reflector, the front surface of said dichroic element being selectively reflective and facing the front surface of the primary reflector, said front surface of the dichroic element having a secondary focus on said axis therebetween for reflecting infrared energy from space reflected from the primary reflector towards the secondary focus, said dichroic element being substantially transparent to MMW energy and having a focus on the axis between the rear surface of the dichroic element and the millimeter wave feed assembly, said millimeter wave lens for re-focusing said millimeter wave energy without significant attenuation.

2. The apparatus of claim 1 further comprising an optical detector located behind the primary reflector and optical means having an optical path being located on the central axis of the primary reflector between the secondary focus and the optical detector for relaying the infrared energy reflected from the dichroic element to said optical detector along said central axis.

3. The apparatus of claim 2 further comprising an optical baffle between the optical means and the dichroic element for shielding the optical means from unwanted infrared energy.

4. The apparatus of claim 2 further comprising cold stop means in the form of an apertured plate located in the optical path adjacent the optical detector, said cold stop means having aperture therein, being sized in accordance with the optical means so as to be optically equivalent to the common aperture for shielding the optical detector from optical energy which does not fall within the common aperture.

5. The apparatus of claim 1 further comprising a waveguide means for relaying millimeter wave energy between the feed horn and a millimeter wave energy processing location.

6. The apparatus of claim 1 wherein the feed horn comprises:

four symmetrical millimeter wave feed channels directed in opposite pairs at the primary reflector, each opposite pair located on an axis parallel with the central axis of the primary reflector establishing sum and difference channels for transmitting and receiving circularly polarized millimeter wave energy in elevation and azimuth;

comparator means for phase shifting the millimeter wave energy in the difference channel 180° with respect to the sum channel for each of the elevation and azimuth;

polarizer means including a corresponding polarizer for each feed channel for circularly polarizing the millimeter wave energy in each channel.

7. The apparatus of claim 1 further comprising:

mounting means for securing the primary reflector in spaced relationship with the dichroic element.

8. The apparatus of claim 7 wherein the mounting means comprises a base portion for supporting the primary reflector;

a support ring for receiving the dichroic element therein; and a plurality of radial support struts extending from the support ring for attachment with the primary reflector support near a marginal edge thereof.

9. The apparatus of claim 8 wherein the support struts are integrally formed with the support ring and are symmetrically disposed with respect to the axis of the reflector.

10. The apparatus of claim 9 further comprising a plurality of waveguides, one for each support strut, said waveguides and struts being located in adjacent axial spaced relationship about the central axis of the primary reflector for reducing shading of the primary reflector.

11. The apparatus of claim 7 wherein the mounting means comprises waveguide means having end portions coupled to the feed horn for supporting the feed horn in spaced relation to the primary reflector and a support ring for the dichroic element.

12. The apparatus of claim 1 further comprising optical means including a cylindrical housing extending through the opening in the primary reflector and being coaxial therewith and optical elements located in the cylindrical housing along the central axis; said housing having an input opening spaced from the dichroic element, the optical elements being in recessed space relationship with respect to the input opening within the housing.

13. The apparatus of claim 12 wherein the housing further includes a tapered end portion extending from the input opening towards the primary reflector for providing clearance for the millimeter wave energy travelling along the path between the primary reflector and the feed horn.

14. The apparatus of claim 1 wherein the feed assembly comprises a plurality of axially stacked apertured discs coaxially located along the central axis of the primary reflector for guiding millimeter wave energy through the feed assembly the disks having apertures therein forming sum and difference channels in the fed assembly for establishing azimuth and elevation and circular polarization of the millimeter wave energy.

15. The apparatus of claim 1 further comprising circuit means for transmitting and receiving millimeter wave energy to and from the feed horn.

16. Apparatus of claim 15 further comprising infrared and millimeter wave processing circuit means responsive to IR and MMW energy for processing the IR and MMW energy into IR and MMW image signals and correlation circuit means responsive to the processing means for superimposing and correlating the IR and MMW image signals for enhanced imaging accuracy.

17. The apparatus of claim 1 wherein the primary reflector and the dichroic element are in a cassegrain configuration.

18. The apparatus of claim 1 wherein the dichroic element has a dichroic coating for reflecting infrared and transmitting millimeter wave energy.

19. The apparatus of claim 1 further comprising radome means substantially transparent to IR and millimeter wave energy for covering the aperture.

20. The apparatus of claim 6 further comprising waveguide means coupled to the feed horn including at least one corresponding waveguide for carrying MMW energy to each feed channel.

21. A millimeter wave and infrared common imaging aperture for transmitting and receiving of MMW energy to and from space and for receiving IR energy for space comprising:

a primary parabolic reflector for reflecting optical and millimeter wave energy, said primary reflector having a central axis and a focus on the axis opposite the reflector;

a feed assembly having a feed horn located on the axis in the vicinity of the focus for feeding millimeter wave energy along a path to the primary reflector for transmission to space and for receiving from space millimeter wave energy reflected to the focus from the primary reflector along the path;

a dichroic element located facing the primary reflector in the path between the feed assembly and the primary reflector having an axis coaxial therewith and a secondary focus on said axis coaxial therewith and a secondary focus on said axis for reflecting optical energy reflected from the primary reflector towards the secondary focus, said dichroic element being substantially transparent to MMW energy and having non-uniformly spaced apart surfaces for allowing said millimeter wave energy to re-focus onto the feed assembly without significant attenuation;

optical means for relaying the optical energy reflected from the dichroic element to an output focal plane; and circuit mans responsive to the millimeter wave energy and the optical energy for producing corresponding MMW and optical image signals and correlation means responsive to the circuit means for producing a correlated superimposed image representation of the image signals.

22. The imaging aperture of claim 21 wherein the circuit means comprises millimeter wave image processing means for producing an object image in the millimeter wave regime and optical processing means producing an optical image in the optical regime and the correlation means comprises combined imaging means for producing a correlated superimposed optical and high frequency image therefrom.

23. The imaging aperture of claim 21 further comprising acquisition logic responsive to the circuit means and the correlation means for producing an acquisition output indicative of a valid image.

24. The imaging aperture of claim 21 wherein the optical means further comprises a focal plane array of pixel elements being alternately line scannable row by row and column by column and pixel element by pixel element.

25. The imaging aperture of claim 24 wherein the line scan of rows and columns of the focal plane array is relatively faster than pixel element by pixel element scanning.

26. The imaging aperture of claim 24 wherein the feed assembly comprises a millimeter wave energy waveguide operating in elevation and azimuth modes.

27. A method for imaging employing a common aperture in diverse spectral regions comprising the steps of:

transmitting and receiving millimeter wave (MMW) signals along a path by means of a primary reflector, and a MMW transceiver positioned in confronting relation along an optical axis of the primary reflector;

focusing the MMW signals by means of a transparent millimeter wave focusing element located on the optical axis between the transceiver and the primary reflector said focusing element being formed of a lens element having non-uniformly spaced apart surface; and receiving optical signals reflected by means of the primary reflector and a dichroic element located on the millimeter wave focusing element, which dichroic element is aligned with the optical axis, faces the primary reflector and supports the MMW focusing element in the same path as the millimeter wave signals without significant attenuation of said millimeter wave signals.

28. The method of claim 27 further comprising generating corresponding images from each of the millimeter wave and optical signals received; and superimposing and correlating images for verifying the accuracy of the individual images.

29. An infrared (IR) and millimeter wave (MMW) common aperture antenna for transmitting MMW energy to space and for receiving MW and IR energy from space through said common aperture comprising:

a primary parabolic reflector having a reflective surface sized for defining said common aperture, said primary reflector for reflecting infrared and millimeter wave energy impinging thereon, said primary reflector having a central opening, a central axis passing therethrough and a focus spaced from the reflective surface on the axis;

a millimeter wave feed assembly having a feed horn located on the axis in the vicinity of the focus of the primary reflector for feeding millimeter wave energy for transmission along the path from the feed horn to the primary reflector for reflection therefrom to space and for receiving millimeter wave energy from space reflected from the primary reflector along the path to the feed horn;

a dichroic element located in the path between the feed horn and the primary reflector having an axis coaxial with the primary reflector, said dichroic element having a selectively reflective surface facing the surface of the primary reflector and a secondary focus on the axis therebetween for reflecting infrared energy from space reflected from the primary reflector towards the secondary focus, said dichroic element being substantially transparent to MMW energy and shaped for focusing said millimeter wave energy towards said millimeter wave feed without significant attenuation; and optical means including a cylindrical housing extending through the opening int eh primary reflector and being coaxial therewith, and optical elements located in the cylindrical housing along the central axis, said housing having an input opening in spaced relation from the dichroic element, the optical elements being in recessed spaced relationship with respect to the input opening within the housing and the housing includes a tapered end portion extending from the input opening towards the primary reflector for providing clearance for the millimeter wave energy traveling along the path between the primary reflector and the feed horn.

* * * * *